US009597256B1

(12) United States Patent
Paul

(10) Patent No.: US 9,597,256 B1
(45) Date of Patent: Mar. 21, 2017

(54) INTEGRAL ONE PIECE GUM SOOTHER

(71) Applicant: Delores Ann Paul, Odessa, TX (US)

(72) Inventor: Delores Ann Paul, Odessa, TX (US)

( * ) Notice: Subject to any disclaimer, the term of this patent is extended or adjusted under 35 U.S.C. 154(b) by 0 days.

(21) Appl. No.: 15/197,512

(22) Filed: Jun. 29, 2016

(51) Int. Cl.
*A61J 17/00* (2006.01)
*A61H 23/02* (2006.01)

(52) U.S. Cl.
CPC . *A61H 23/0263* (2013.01); *A61H 2201/1215* (2013.01)

(58) Field of Classification Search
CPC ..... A61H 13/00; A61H 23/00; A61H 23/02; A61H 23/0254; A61H 23/0263; A61H 2201/00; A61H 2201/0157; A61H 2201/12; A61H 2201/1207; A61H 2201/169; A61H 2201/1692; A61H 2201/1695; A61H 2201/1215
See application file for complete search history.

(56) References Cited

U.S. PATENT DOCUMENTS 4,716,902 A * 1/1988 Swartz ..... A61J 17/00 362/800
5,292,335 A * 3/1994 Shin ..... A61J 17/00 606/234
5,649,964 A 7/1997 Berman et al.
5,693,073 A 12/1997 Glick et al.
5,711,759 A * 1/1998 Smith ..... A61J 17/00 601/139
5,902,322 A 5/1999 Scagliotti
6,053,881 A * 4/2000 Boodramsingh ..... A61H 23/02 601/133
6,264,678 B1 * 7/2001 Landers ..... A61J 17/00 606/234
6,468,294 B2 * 10/2002 Griffith ..... A61J 17/00 601/67
6,591,140 B2 * 7/2003 Strome ..... A61H 13/00 606/234
7,211,102 B2 5/2007 DeSousa et al.
D593,203 S * 5/2009 Kliegman ..... D24/194
2003/0171647 A1 * 9/2003 Garland ..... A61H 19/44 600/38
2013/0178769 A1 * 7/2013 Schmidt ..... A61H 19/34 601/46

* cited by examiner

*Primary Examiner* — Steven Douglas
(74) *Attorney, Agent, or Firm* — Buskop Law Group, PC; Wendy Buskop

(57) ABSTRACT

An integral one piece gum soother with a bristle-less wand, an internal vibrating device, a power supply connected to the internal vibrating device, an on/off switch for activating the internal vibrating device, and a mouth guard connected to the bristle-less wand. The mouth guard can extend at a first angle from the bristle-less wand and a flex neck connected to the bristle-less wand can extend at a second angle from the mouth guard. A hollow membrane-free dual chew tip can be connected to the flex neck, wherein the hollow membrane-free dual chew tip can be configured to sustain a reduced temperature from room temperature of at least 20 degrees Fahrenheit if needed.

17 Claims, 2 Drawing Sheets

INTEGRAL ONE PIECE GUM SOOTHER

SPECIFICATION

FIELD

The present embodiments generally relate to an integral one piece gum soother.

BACKGROUND

A need exists for a device that individuals can use to massage gums without fear of choking.

A further need exists for children to have a device that helps improve dental hygiene at an early age, as well as accelerate teeth cutting.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an integral one piece gum soother. The present embodiments further relate to an integral one piece gum soother having a bristle-less wand with an internal vibrating device.

The bristle-less wand can house a power supply connected to the internal vibrating device and support an on/off switch connected between the power supply and the internal vibrating device.

A mouth guard can be connected to the bristle-less wand and can extend at a first angle, such as from 40 degrees to 120 degrees from the bristle-less wand.

A flex neck can be integrally connected longitudinally to the bristle-less wand and can extend at a second angle, such as from 40 degrees to 120 degrees from the mouth guard.

In embodiments, the integral once piece gum soother can have a hollow membrane-free dual chew tip connected to the flex neck, which can partially contain the vibrating device.

In embodiments, the hollow membrane-free dual chew tip can be configured to sustain a reduced temperature from room temperature to at least 20 degrees Fahrenheit if needed.

The embodiments work effectively and instantly to release pressure in infant's ears during flying or travel by enabling them to chew safely on a vibrating device that can also soothe them.

The embodiments lessen teething time for young children and encourage teeth to come in sooner while reducing pain to the young child or infant of 4 months old.

The embodiment can freeze to a semi-solid with no condensation to more quickly reduce swelling or inflammation of gums while vibrating.

The embodiments encourage an infant or young child to get used to placing an object, similar to a toothbrush, into the mouth early in life to create good oral hygiene habits.

The embodiments have a mouth guard to prevent chocking and death in infants and young children of up to 6 years.

Figure 1:
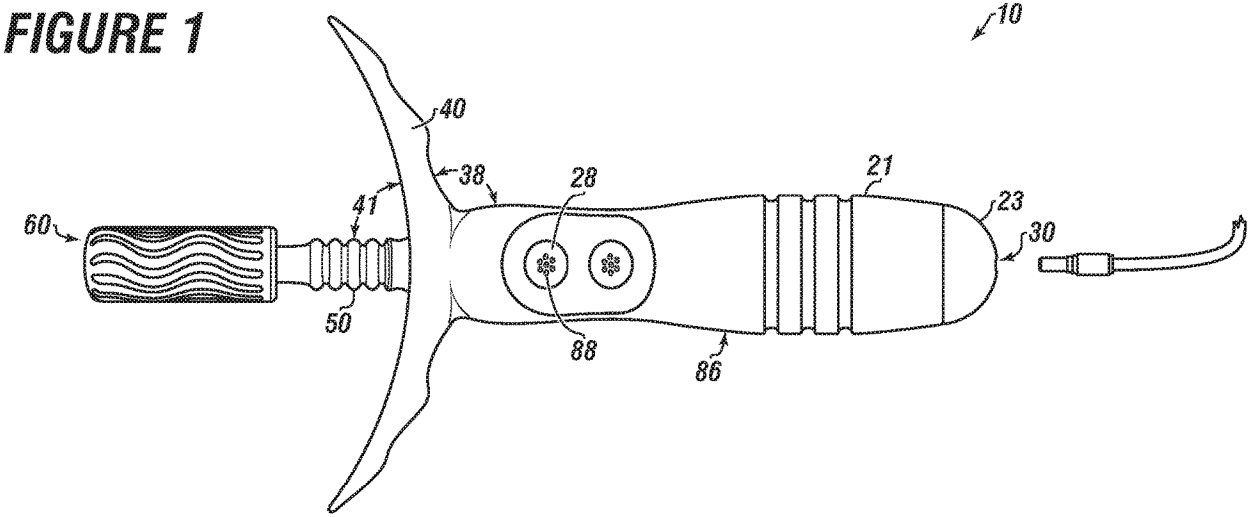
FIG. 1 depicts a side view of an integral one piece gum soother according one or more embodiments.

Turning now to the Figures, FIG. 1 depicts a side view of an integral one piece gum soother according one or more embodiments.

The integral one piece gum soother 10 can have a bristle-less wand 21.

The bristle-less wand 21 can have an on/off switch 28 with a switch locator 88 so that a user can easily locate the on/off switch 28. The switch locator 88 can be a series of bumps or depressions on the on/off switch 28. The on/off switch can be a pressure actuated switch.

An ergonomic grip 86 can be formed on an outer surface of the bristle-less wand 21, allowing a user to obtain a sure and comfortable grip on the bristle-less wand 21. In embodiments, the ergonomic grip 86 can be tapered. In other embodiments, the ergonomic grip 86 can have finger depressions for each finger of a child holding the bristle-less wand 21. Four finger depressions can be formed, each having a depth of about 0.3 inches to 0.5 inches.

A removable detachable cap 23 can be mounted to the bristle-less wand 21. The removable detachable cap can provide easy access for the changing of a power supply, such as a non-rechargeable battery.

The removable detachable cap 23 can include a safety screw to ensure a child cannot swallow, choke or be injured from the use of the device. Unlike other devices with loose caps, the integral one piece gum soother can prevent choking in children, while stimulating their gums.

The bristle-less wand 21 can have a charging port 30, which can penetrate the removable detachable cap 23 to allow for easy charging of the power supply. In embodiments, the power supply can be an onboard power supply, which can be a rechargeable battery.

In embodiments, the batteries can be from 2 AAA to 4 AAA DC batteries connected together. In other embodiments, the batteries can be from 1 AA to 2 AA DC batteries or a single 9-volt DC battery.

The charging port 30 can be a USB compatible port, such as a mini USB compatible port. The charging port can be an A/C port, a D/C port or any other style of charging port.

A mouth guard 40 can be connected to the bristle-less wand 21. The mouth guard 40 can extend at a first angle 38. The first angle 38 can range from 40 degrees to 120 degrees from the bristle-less wand 21.

In embodiments, the mouth guard can be made from a harder, thicker silicone rubber material than the bristle-less wand 21.

A flex neck 50 can extend longitudinally from the bristle-less wand 21. The flex neck 50 can be oriented at a second angle 41 from the mouth guard 40. The second angle 41 can range from 40 degrees to 120 degrees.

A hollow membrane-free dual chew tip 60 can be connected longitudinally to the flex neck 50. The hollow membrane-free dual chew tip 60 can be heated or cooled dependent on the user's preference.

In embodiments, the hollow membrane-free dual chew tip 60 can have a larger outer diameter than the flex neck, such as from 10 percent to 25 percent larger. The hollow membrane-free dual chew tip 60 should be sufficiently large in outer diameter to cover gums of a child without being overly large in the child's mouth to prevent chocking or other bodily harm to a child while simultaneously providing comfort to the mouth of the child.

Figure 2:
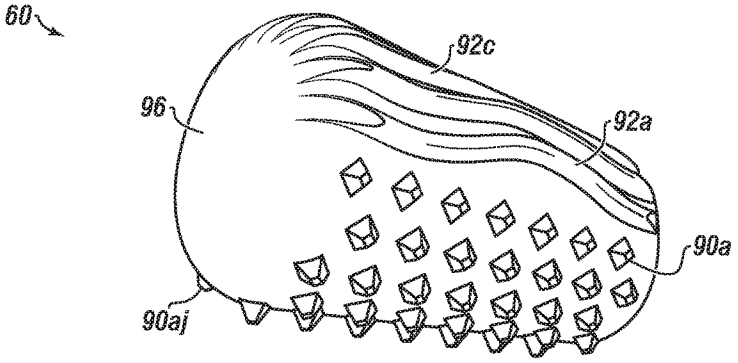
FIG. 2 depicts detailed view of a hollow membrane-free dual chew tip of the integral one piece gum soother according to one or more embodiments.

FIG. 2 depicts detailed view of a hollow membrane-free dual chew tip of the integral one piece gum soother according to one or more embodiments.

The hollow membrane-free dual chew tip 60 can have an outer surface 96.

In embodiments, the hollow membrane-free dual chew tip 60 can be tapered. In embodiments, the hollow membrane-free dual chew tip 60 can be cylindrical in shape.

A plurality of facets 90*a*-90*aj* and a plurality of ridges 92*a*-92*c* can be formed on the outer surface 96 of the hollow membrane-free dual chew tip 60.

In embodiments, the plurality of facets 90*a*-90*aj* can extend from the outer surface of the hollow membrane-free dual chew tip 60 from 0.1 mm to 0.3 mm and have a density of facets ranging from 6 facets per $cm^2$ to 12 facets per $cm^2$.

The plurality of facets can be any geometric shape such as diamond shaped, pyramid shaped, round shaped or combinations thereof. The plurality of facets can be curvilinear.

In embodiments, the plurality of facets can be filled and solid to enable a child to apply pressure to the gums for comforting compression.

In embodiments, the plurality of facets can be molded from the same material as the outer surface 96 of the hollow membrane-free dual chew tip 60. The plurality of facets can be made from a rubberized silicon material.

In embodiments, the plurality of ridges 92*a*-92*c* can extend from the outer surface 96 of the hollow membrane-free dual chew tip 60. The plurality of ridges can extend from the outer surface from 0.1 mm to 0.3 mm and have a density ranging from 2 ridges to 6 ridges per centimeter of the outer surface.

In embodiments, the plurality of ridges can be parallel to each other. In other embodiments, the plurality of ridges can be grouped and a first group of parallel ridges can be at a right angle to a second group of parallel ridges.

In other embodiments, the plurality of ridges can be curvilinear or wavy.

Each ridge of the plurality of ridges can have a thickness ranging from 0.08 mm to 0.12 mm.

Figure 3:
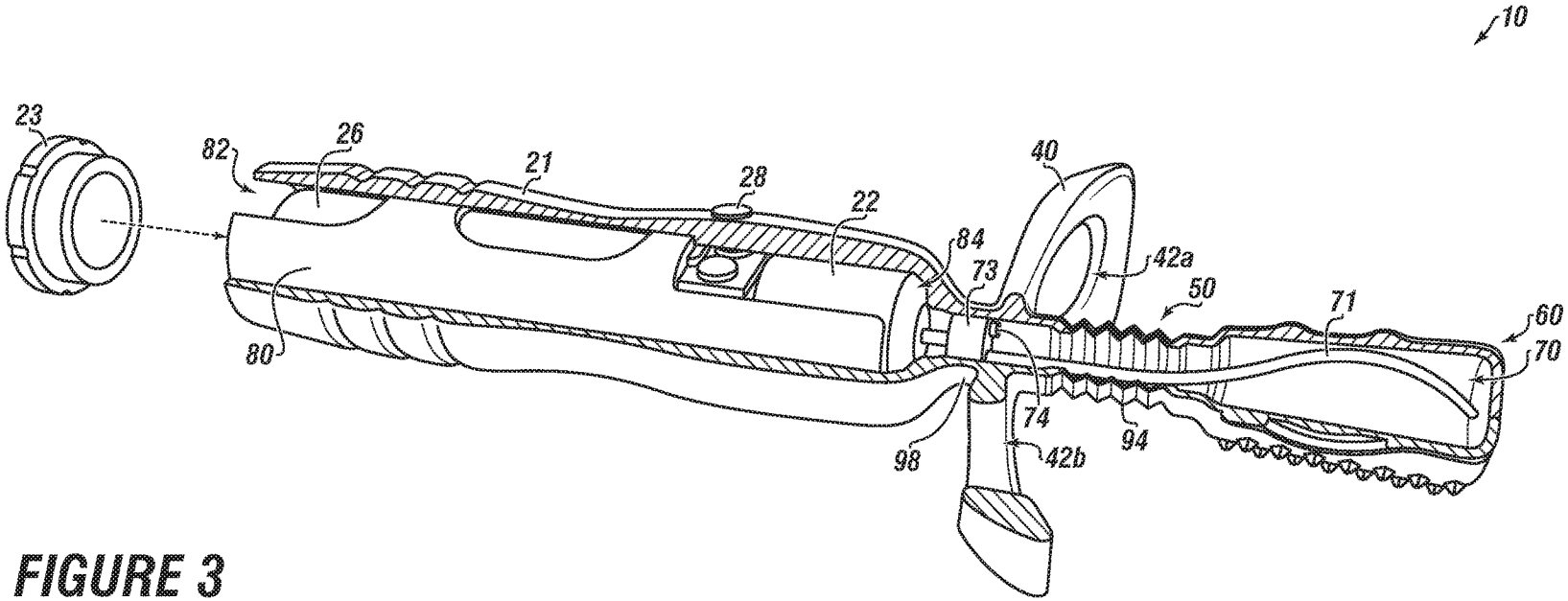
FIG. 3 depicts a partial cut view of the integral one piece gum soother according to one or more embodiments.

FIG. 3 depicts a partial cut view of the integral one piece gum soother according to one or more embodiments.

The integral one piece gum soother 10 can have a bristle-less wand 21.

In embodiments, the bristle-less wand 21 can have a length from 7 cm to 10 cm and a diameter ranging from 1.5 cm to 3 cm.

In embodiments, the bristle-less wand 21 can be a molded one piece unit formed from a silicone based plastic incorporating a soft rubber or similar material.

In embodiments, the bristle-less wand 21 can have a wall thickness from about 0.05 mm and 0.20 mm.

In embodiments, the bristle-less wand 21 can have an internal casing 80 contained inside the bristle-less wand 21.

In embodiments, the internal casing 80 can be force fit within the bristle-less wand 21.

The internal casing 80 can have a first chamber 82 and a second chamber 84.

In embodiments, the first chamber 82 can hold a power supply 26 and can be accessed by the removable detachable cap 23.

The power supply 26 can be a rechargeable battery, a non-rechargeable battery, a solar cell or combinations thereof.

The second chamber 84 can contain the on/off switch 28 and a motor 22. The on/off switch can be a pressure switch, which can be light pressure, operable by a child or an elderly person without much ability to apply pressure.

In embodiments, the second chamber 84 can be tapered at one end to contain the motor 22 in a snug fit.

In embodiments, the motor 22 can cycle for a predetermined duration when activated by the on/off switch 28. For example, the motor can operate for 5 minutes then shut off. In other embodiments, the motor can operated until it is powered off.

In embodiments, the motor 22 can be attached to an internal vibrating device 70.

The internal vibrating device 70 can comprise a rotating vibrating arm 71 connected to a rotating device 73.

In embodiments, the rotating device 73 can include an eccentric weight 74 that facilitates in vibrating the bristle-less wand 21. In other embodiments, the rotating vibrating arm 71 can be offset on the rotating device 73 providing the vibrating action needed to soothe the child's gums.

The mouth guard 40 can be connected to the bristle-less wand 21 and can have a plurality of vents 42*a* and 42*b* for rash prevention formed therein to prevent rashes from forming on cheeks of a user.

The mouth guard 40 can also prevent the child from inserting the bristle-less wand too far into their mouth, which could cause to damage the user's throat or choking.

While two vents 42*a* and 42*b* are shown, more vents can be formed in the mouth guard 40. In embodiments, the diameter of each vent can range from a 1 cm diameter to 2 cm diameter.

In embodiments, the mouth guard 40 can have a thickness ranging from 0.50 cm to 1.5 cm and a diameter ranging from 5 cm and 7 cm.

In embodiments, the mouth guard 40 can be molded to conform to lips of a user.

The flex neck 50 can extend longitudinally from the bristle-less wand 21. The flex neck 50 can have at least one elevation 94 to increase the flexible range of the flex neck 50, while also allowing a user to have an area to grip the flex neck 50 with their lips.

The at least one elevation 94 can have a height ranging from 0.1 mm to 0.5 mm from the surface of the flex neck.

In embodiments, the flex neck 50 can bend from 1 degree to 45 degrees and can have a length from 0.5 cm to 1.5 cm and a diameter from 0.5 cm to 1.5 cm.

In embodiments, the hollow membrane-free dual chew tip 60 can be configured to sustain a reduced temperature from room temperature of at least 20 degrees Fahrenheit if needed.

For example, the entire integral one piece gum soother 10 can be placed in a refrigerator or freezer compartment of a home refrigerator/freezer and left to chill, such as for at least 1 hour. Upon removal from the refrigerator/freezer the temperature of the integral one piece gum soother 10 will have dropped from room temperature of 80 degrees Fahrenheit to 60 degrees Fahrenheit, giving a child a cool wand to chew on, providing a device that reduces inflammation of the gums.

The hollow membrane-free dual chew tip 60 can be connected to the flex neck 50.

In embodiments, the hollow membrane-free dual chew tip 60 can be heated or cooled dependent on the user's preference.

In embodiments, the hollow membrane-free dual chew tip 60 can have a length from 1.5 cm to 2.5 cm and a diameter from 1 cm to 1.5 cm.

The integral one piece gum soother 10 can have a hollow body reducer 98 connecting between the mouth guard 40 and the motor 22. As an example, the hollow body reducer can narrow the outer diameter of the bristle-less wand 21 by 40 percent to 60 percent.

The following is an example of the use of the integral one piece gum soother, but is not limited to this embodiment.

Baby Tinsley is teething. Mother Lori or other caregiver can turn on the integral one piece gum soother using the on/off switch.

Mother Lori then gives Baby Tinsley the integral one piece gum soother. The Baby Tinsley takes the bristle-less wand and chews on the hollow membrane-free dual chew tip, sometimes putting the hollow membrane-free dual chew tip 60 into the mouth up to the mouth guard.

Baby Tinsley is able to reach the back molars or hard to reach areas for teething because of the flex neck.

The device is comforting to Baby Tinsley because it has a plurality of facets that fit into where the teeth are coming in and simultaneously a plurality of ridges that massage the top gums. The bristle-less wand prevents Baby Tinsley from getting infections. Also, the bristle-less wand prevents gum irritation caused by bristles.

The embodiments include a method of massaging the gums of a user. The method can involve placing the hollow membrane-free dual chew tip proximate to a child's mouth and proximate to a child's hand, activating the on/off switch, and applying motion to the hollow membrane-free dual chew tip.

While these embodiments have been described with emphasis on the embodiments, it should be understood that within the scope of the appended claims, the embodiments might be practiced other than as specifically described herein.

What is claimed is:

1. An integral one piece gum soother comprising:

a. a bristle-less wand comprising:
   (i) a motor;
   (ii) a power supply connected to the motor;
   (iii) an on/off switch connected between the power supply and the motor for activating the motor; and
   (iv) an internal vibrating device connected to the motor;

b. a mouth guard connected to the bristle-less wand extending at a first angle from 40 degrees to 120 degrees from the bristle-less wand;

c. a flex neck connected longitudinally to the bristle-less wand extending at a second angle from 40 degrees to 120 degrees from the mouth guard; and d. a hollow membrane-free dual chew tip connected to the flex neck, wherein the hollow membrane-free dual chew tip is configured to contact and massage gums and sustain a reduced temperature from room temperature to at least 20 degrees Fahrenheit if needed, and further wherein the hollow membrane-free dual chew tip contains a rotating vibrating arm.

2. The integral one piece gum soother of claim 1, comprising an internal casing contained inside the bristle-less wand having a first chamber containing the power supply and a second chamber containing the on/off switch and the motor.

3. The integral one piece gum soother of claim 1, wherein the power supply is at least one of: a non-rechargeable battery, a solar cell, and a rechargeable battery.

4. The integral one piece gum soother of claim 1, comprising a charging port connected to the power supply for recharging the power supply and providing a USB port connection.

5. The integral one piece gum soother of claim 1, wherein the bristle-less wand is a molded one piece unit.

6. The integral one piece gum soother of claim 1, wherein the bristle-less wand is at least one of: a silicone based plastic, a soft rubber, or a rubberized silicon material.

7. The integral one piece gum soother of claim 1, comprising a removable detachable cap mounted to the bristle-less wand.

8. The integral one piece gum soother of claim 1, comprising a plurality of vents formed in the mouth guard.

9. The integral one piece gum soother of claim 1, wherein the vibrating device comprises the rotating vibrating arm connected to a rotating device that further engages the motor.

10. The integral one piece gum soother of claim 1, comprising an ergonomic grip formed on an outer surface of the bristle-less wand.

11. The integral one piece gum soother of claim 1, comprising a switch locator on an outer surface of the bristle-less wand for easily locating the on/off switch mounted within the bristle-less wand.

12. The integral one piece gum soother of claim 1, wherein the mouth guard is curved to conform to lips of a user.

13. The integral one piece gum soother of claim 1, wherein the hollow membrane-free dual chew tip comprises a plurality of facets and a plurality of ridges mounted on an outer surface of the hollow membrane-free dual chew tip.

14. The integral one piece gum soother of claim 1, wherein the flex neck has at least one elevation formed from the flex neck.

15. The integral one piece gum soother of claim 1, comprising a hollow body reducer connecting between the mouth guard and the motor.

16. The integral one piece gum soother of claim 9, wherein the rotating device comprises an eccentric weight.

17. The integral one piece gum soother of claim 1, wherein a wall thickness of the bristle-less wand is from 0.05 mm to 0.20 mm.

* * * * *